US006626067B1

(12) United States Patent
Iwinski et al.

(10) Patent No.: US 6,626,067 B1
(45) Date of Patent: Sep. 30, 2003

(54) RETENTION SOCKET GEOMETRY VARIATIONS

(75) Inventors: Dean J. Iwinski, Muskego, WI (US); Marco DeVecchis, Racine, WI (US); Bert Krivec, Brookfield, WI (US); Kurt L. Sauer, Union Grove, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 332 days.

(21) Appl. No.: 09/672,228

(22) Filed: Sep. 27, 2000

(51) Int. Cl.[7] ..... B25B 13/00

(52) U.S. Cl. ..... 81/121.1; 81/124.3; 81/124.7; 81/436; 411/403; 411/919

(58) Field of Search ..... 81/121.1, 124.3, 81/124.7, 120, 121 R, 53.2, 436; 411/403, 404, 405, 919

(56) References Cited

U.S. PATENT DOCUMENTS

| | | | | |
|---|---|---|---|---|
| 2,202,240 A | | 5/1940 | Trotter | |
| 3,463,209 A | | 8/1969 | Podolsky | |
| 3,834,253 A | | 9/1974 | Carr | |
| 3,835,737 A | | 9/1974 | Carr | |
| 3,996,819 A | | 12/1976 | King | |
| 4,060,113 A | | 11/1977 | Matsushima | |
| 4,126,063 A | | 11/1978 | Palmer | |
| 4,145,939 A | | 3/1979 | Garrison | |
| 4,384,812 A | | 5/1983 | Miyagawa | |
| 4,457,654 A | | 7/1984 | Sygnator | |
| 4,607,547 A | | 8/1986 | Martus | |
| 4,644,831 A | | 2/1987 | Yang | |
| 4,911,593 A | | 3/1990 | Kephart | |
| 4,930,378 A | * | 6/1990 | Colvin | 81/121.1 |
| 4,934,226 A | | 6/1990 | Dacey, Jr. | |
| 4,947,712 A | | 8/1990 | Brosnan | |
| 4,970,922 A | | 11/1990 | Krivec | |
| 5,012,706 A | * | 5/1991 | Wright et al. | 81/121.1 |
| 5,019,080 A | | 5/1991 | Hemer | |
| 5,105,690 A | | 4/1992 | Lazzara et al. | |
| 5,174,704 A | * | 12/1992 | Kazino et al. | 411/403 |
| 5,219,253 A | | 6/1993 | Shinjo | |
| 5,219,392 A | * | 6/1993 | Ruzicka et al. | 81/124.3 |
| 5,277,531 A | | 1/1994 | Krivec | |
| 5,279,190 A | * | 1/1994 | Goss et al. | 81/460 |
| 5,507,211 A | | 4/1996 | Wagner | |
| 5,904,076 A | * | 5/1999 | Siwy | 81/121.1 |
| 6,003,411 A | | 12/1999 | Knox et al. | |
| 6,131,493 A | * | 10/2000 | Yamamoto et al. | 81/124.7 |
| 6,199,455 B1 | * | 3/2001 | Wagner | 81/121.1 |
| 6,354,175 B1 | * | 3/2002 | Dobson et al. | 81/119 |

FOREIGN PATENT DOCUMENTS

| | | |
|---|---|---|
| EP | 0 442 511 | 8/1991 |
| EP | 0 596 374 | 6/1992 |

* cited by examiner

*Primary Examiner*—Joseph J. Hail, III
*Assistant Examiner*—Anthony Ojini
(74) *Attorney, Agent, or Firm*—Seyfarth Shaw

(57) ABSTRACT

A device includes a body having a plurality of alternating drive regions and corner regions arranged about a central axis for cooperation to define a socket recess having an open outer end and an inner end. Each drive region has a drive surface disposed thereon and confined thereto. At least one drive surface slopes toward the central axis in a first direction generally parallel to the central axis and in a second direction generally traverse to the central axis. The device may be a rotatably driveable device for driving fasteners and the like, wherein the axis is the axis of rotation. The device can be used for retaining and driving a drive member. In one form, a drive member, comprising alternating flats and corners is inserted into the device. The flats of the drive member frictionally engage with at least two of the drive regions, thereby releaseably retaining the drive member in the body. The drive member can be rotated by rotating the body in one of the clockwise and counter-clockwise directions. The corner regions can comprise channels formed between two drive regions to prevent engagement of the corners of the drive member with the body. Similar principles are also applied to create drive surfaces for a male driver that retain and drive a device having a complementary female socket.

18 Claims, 11 Drawing Sheets

RETENTION SOCKET GEOMETRY VARIATIONS

BACKGROUND

The following disclosure relates to devices having female sockets adaptable for matably receiving complementary shaped male members. The following disclosure has particular application to apparatus and methods for retaining the male member in the female socket.

Various types of rotatably driveable devices, such as drive sockets for wrenches and socket-head threaded fasteners, are provided with a female socket recess adapted for receiving a complementary shaped male drive member. A typical form of such a driveable device has a polygonal socket recess formed in one end of the device coaxially with the axis of rotation. Various techniques have been used to facilitate retaining the driveable device on the associated driving tool or other drive member or, stated another way, to retain the driving tool or member in the socket recess.

One technique is to shape the socket recess and/or the drive member so as to provide an interference fit which will frictionally hold the parts together. Thus, for example, in U.S. Pat. No. 4,970,922, there is disclosed a fluted driving tool which is adapted for engagement in a similarly shaped socket recess, the tool and socket recess having cooperating drive surfaces. The drive surfaces in the socket recess are substantially parallel to the axis of rotation while those on the drive member are given a slight helical twist about the axis of rotation so as to afford a wedge fit in the socket recess.

Another technique is to shape a socket recess so as to provide an interference fit with a standard hexagonal shaped nut, bolt, etc. For example, in U.S. Pat. No. 5,277,531 a socket recess differs from a standard hexagonal shaped recess comprising alternating flats and corners by having built-up portions that extend between what would normally be adjacent flats of a standard hexagonal shaped recess. While perfectly adequate for some uses, this design tends to engage the corners of a nut, bolt, etc. and is not adaptable for situations where contact with the corners of the bolts is not desired. Additionally, the built up portions in this design only slope in one direction across the face of the flats, which only allows this design to achieve the maximum interference fit when the socket is turned in one of the clockwise and counter-clockwise directions, but not the other.

SUMMARY

The disclosed apparatus and methods avoid some of the disadvantages of prior devices and methods while affording additional structural and operating advantages.

One form of the disclosed retention socket device comprises a body having a plurality of alternating drive regions and corner regions arranged about a central axis for cooperation to define a socket recess having an open outer end and an inner end. Each drive region can have a drive surface disposed thereon and confined thereto. The disclosed retention socket device can have at least one drive surface that slopes toward the central axis in directions both generally parallel to and traverse to the central axis.

One form of the disclosed method of retaining and driving a drive member comprises inserting a drive member, comprising alternating flats and corners, in a body comprising alternating drive regions and corner regions. The drive member can be releaseably retained in the body by frictionally engaging the flats of the drive member with at least two of the drive regions. The drive member can be rotated by rotating the body in one of the clockwise and counter-clockwise directions while preventing engagement of the corners of the drive member with the body.

The disclosed rotatably driveable device and drive member consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present disclosed rotatably driveable device and drive member.

BRIEF DESCRIPTION OF THE DRAWINGS

For the purpose of facilitating an understanding of the disclosed apparatus and method, there are illustrated in the accompanying drawings preferred embodiments thereof, from an inspection of which, when considered in connection with the following description, the disclosed apparatus and method, its construction and operation, and many of its advantages should be readily understood and appreciated.

FIG. 11 is a fragmentary side view of a first form of a male member, the male member being a driver for a socket wrench or the like;

FIG. 12 is a fragmentary perspective view of a second form of a male member, the male member being a driver for a socket wrench or the like.

DETAILED DESCRIPTION

Figure 1A:
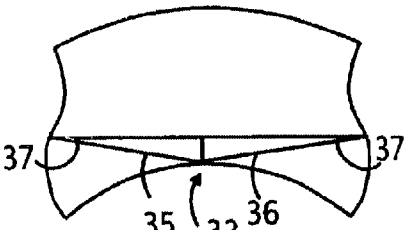
FIG. 1A is a fragmentary top plan view of the female socket of FIG. 1.

Referring to FIGS. 1–10, there is illustrated a body in the nature of a drive socket 20 for a socket wrench. The drive socket 20 has a cylindrical body 21 with a cylindrical curved surface 22, an open outer end surface 24 and an back end (not shown). The drive socket 20 has a central rotational axis X extending through the centers of the open outer end surface 24 and the back end. In one form, axis X is the axis of rotation of drive socket 20.

Formed axially in the open outer end surface 24 is a socket recess 30, which extends into the cylindrical body 21, terminating in an inner end surface 31 in the interior of the socket. In one form, the drive socket 20 is designed for use with a ratchet wrench (not shown) and includes a square drive hole (not shown) at the back end of drive socket 20. The inner end surface 31 is generally located between the back end and some point offset from the open outer end surface 24.

The socket recess 30 has a generally polygonal shape at the open outer end thereof, i.e., at the open outer end surface 24, the shape being generally hexagonal in the illustrated embodiments and including sides, such as drive regions 32, spaced apart by corner regions 33. In the illustrated embodiment, the drive socket 20 has a plurality of alternating drive regions 32 and corner regions 33 arranged about a central axis X for cooperation to define the socket recess 30. Each of the illustrated corner regions 33 comprises a channel-shaped flank relief formed between two drive regions. The reliefs prevent the corners of a drive member, such as fastener 34 (see FIGS. 8 and 9), from contacting the corner regions 33 of socket recess 30. However, the corner regions 33 can also comprise differently shaped flank reliefs. In other cases, the corner regions 33 can even comprise normal corners when contacting the corners of a drive member is of less concern.

Figure 1:
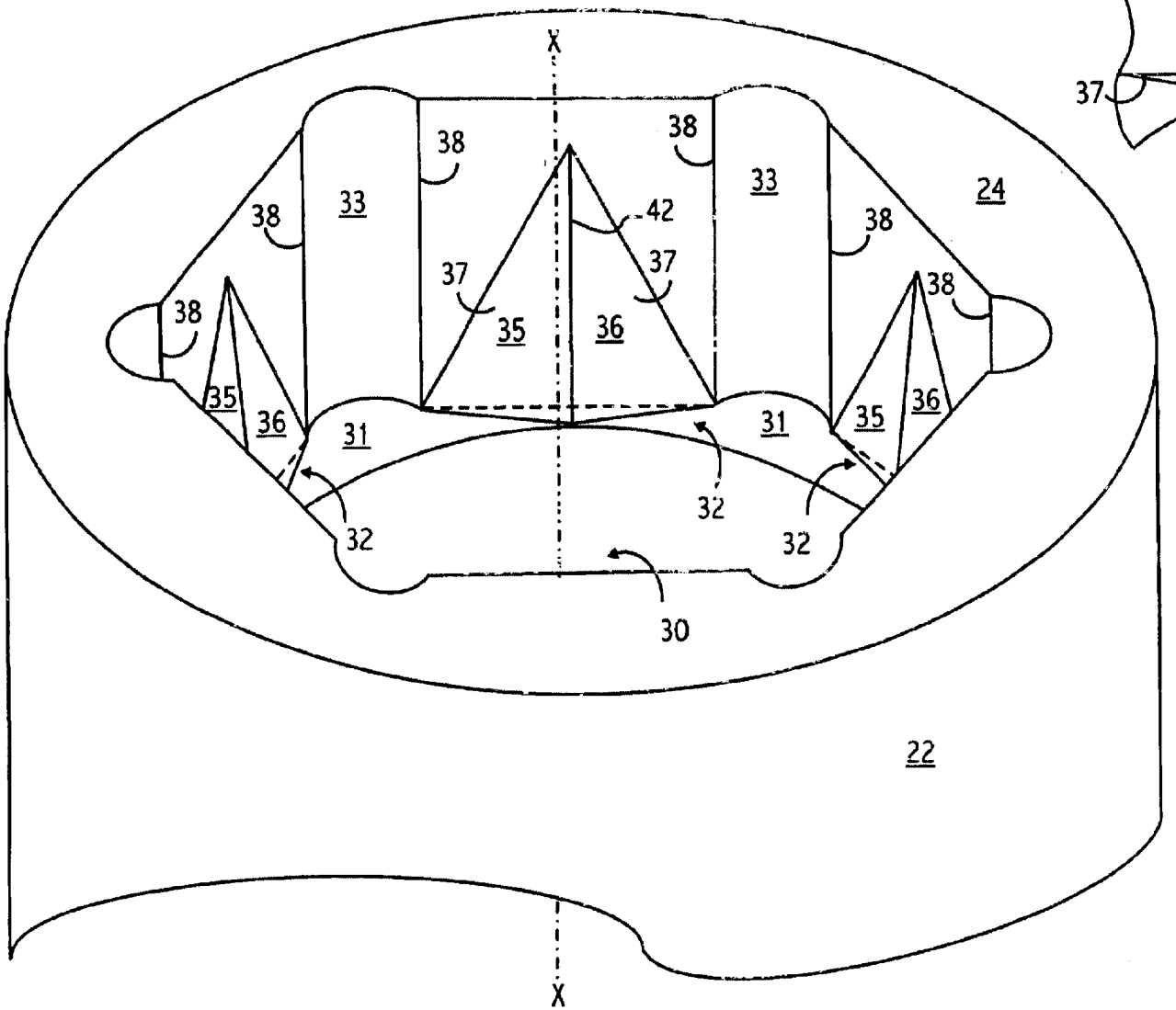
FIG. 1 is a fragmentary perspective view of a first form of a female socket, the female socket being a drive socket for a socket wrench.
Figure 2A:
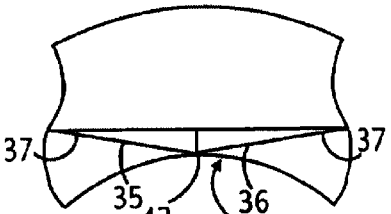
FIG. 2A is a fragmentary top plan view of the female socket of FIG. 2.
Figure 2:
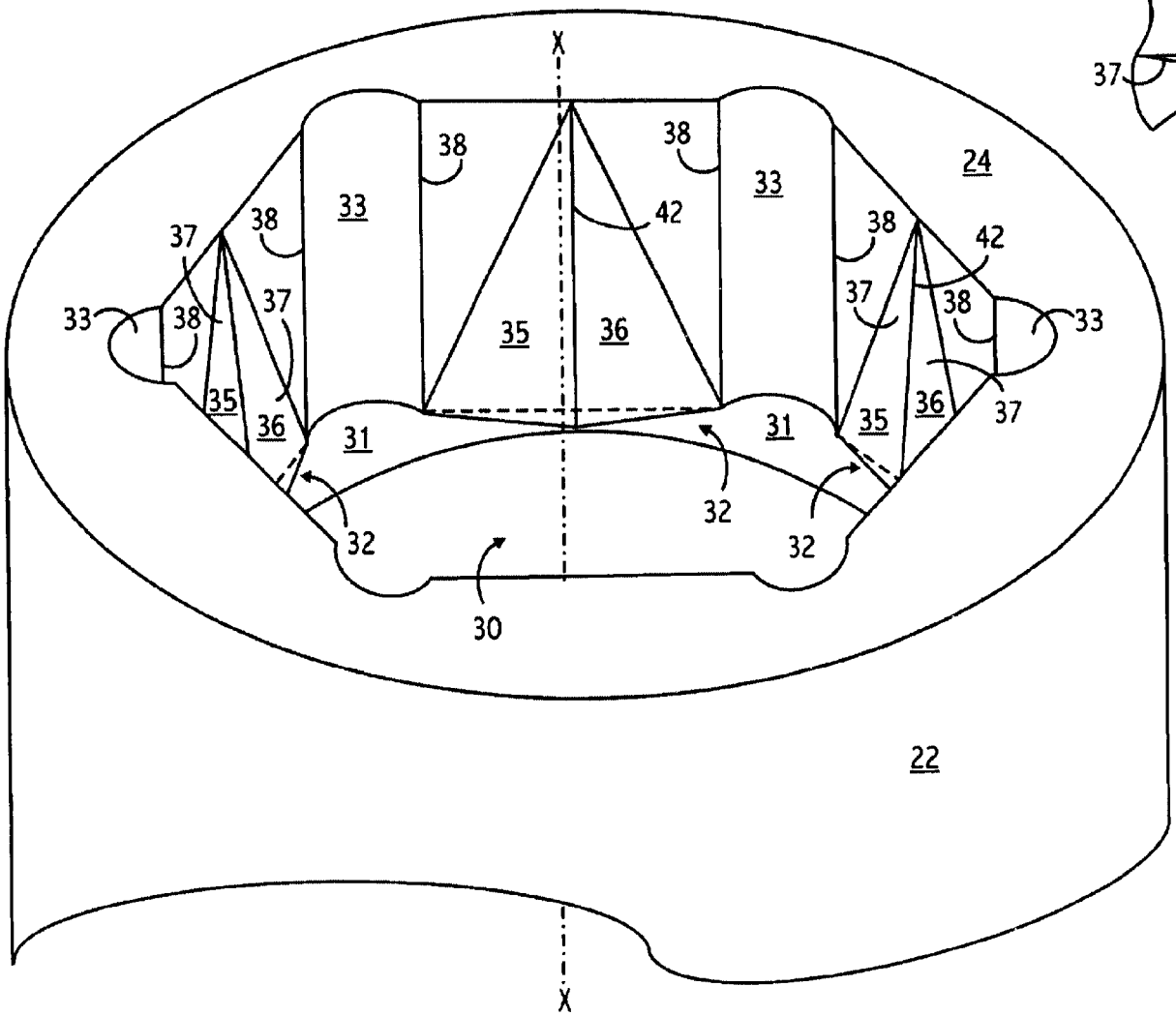
FIG. 2 is a fragmentary perspective view of a second form of a female socket, the female socket being a drive socket for a socket wrench.

The drive region has one or more drive surfaces 35, 36, respectively extending from the drive regions 32 and sloping toward the central axis both generally parallel to the central axis X and generally traverse to the central axis X (see FIG. 1). In other words, one or more drive surfaces 35, 36 slope toward the central axis X in a first direction generally parallel to the central axis, for example along the shortest route between the open outer surface 24 and the inner end surface 31, and in a second direction generally traverse to the central axis, for example the shortest route between two edges 38 of drive region 32. This sloping inward toward the central axis X determines the depth of insertion of the hex head bolt and thus the area of engagement between the hex head bolt 34 and the drive socket 20. In one form, the slope is positive in a direction following the shortest route from the open outer surface 24 towards the inner end surface 31 and in one of the two directions that follow the shortest route between two edges 38 of the drive region 32.

In one form, the drive surfaces 35, 36 extend from the inner end surface 31 towards the open outer end surface 24 and also extend from a point adjacent one of corner regions 33 that borders one edge 38 of a drive region 32 and towards the other corner region 33 bordering the same drive region 32. For purposes of illustration, the size of the drive surfaces 35, 36 have been exaggerated in the drawings since, in some embodiments, they may be difficult to see with the naked eye.

Figure 3A:
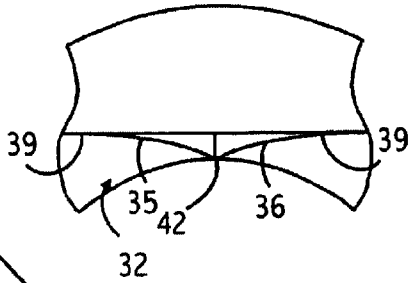
FIG. 3A is a fragmentary top plan view of the female socket of FIG. 3.
Figure 3:
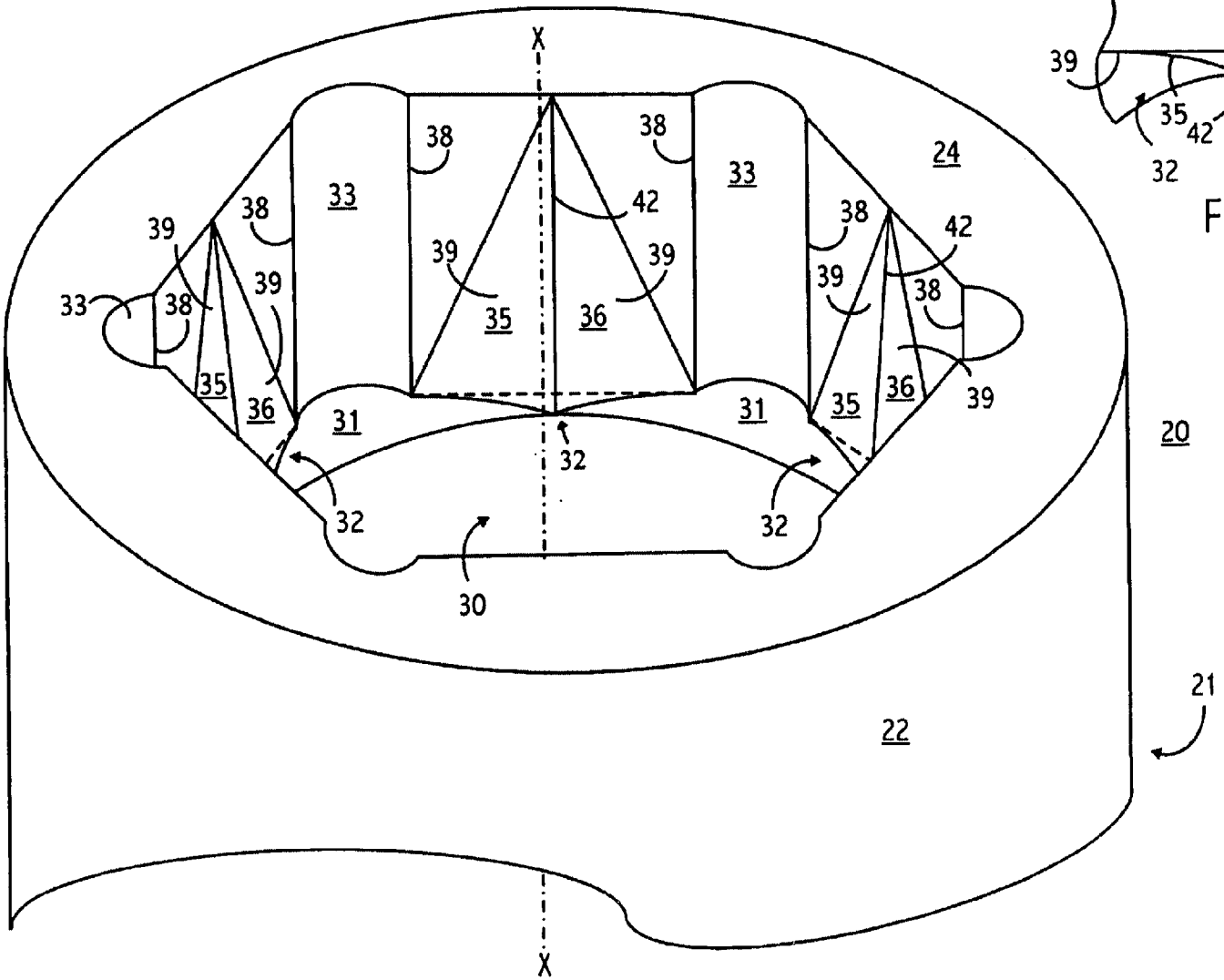
FIG. 3 is a fragmentary perspective view of a third form of a female socket, the female socket being a drive socket for a socket wrench.
Figure 4A:
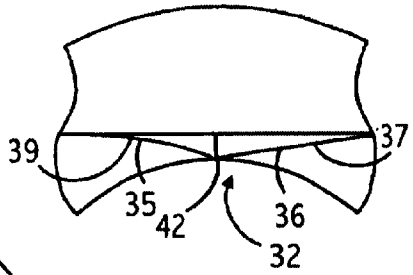
FIG. 4A is a fragmentary top plan view of the female socket of FIG. 4.
Figure 4:
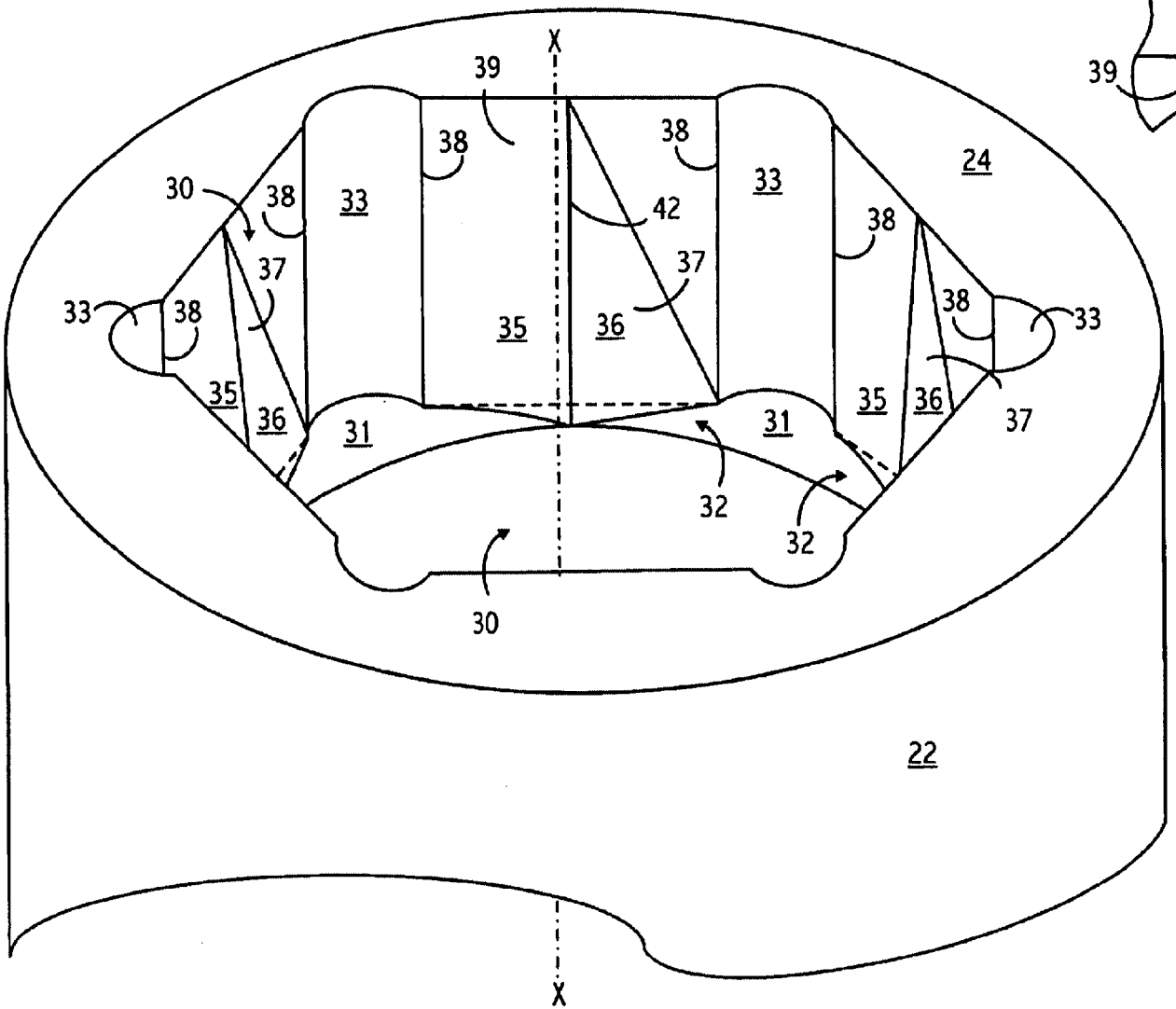
FIG. 4 is a fragmentary perspective view of a fourth form of a female socket, the female socket being a drive socket for a socket wrench.
Figure 5A:
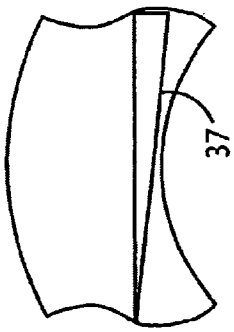
FIG. 5A is a fragmentary top plan view of the female socket of FIG. 5.
Figure 5:
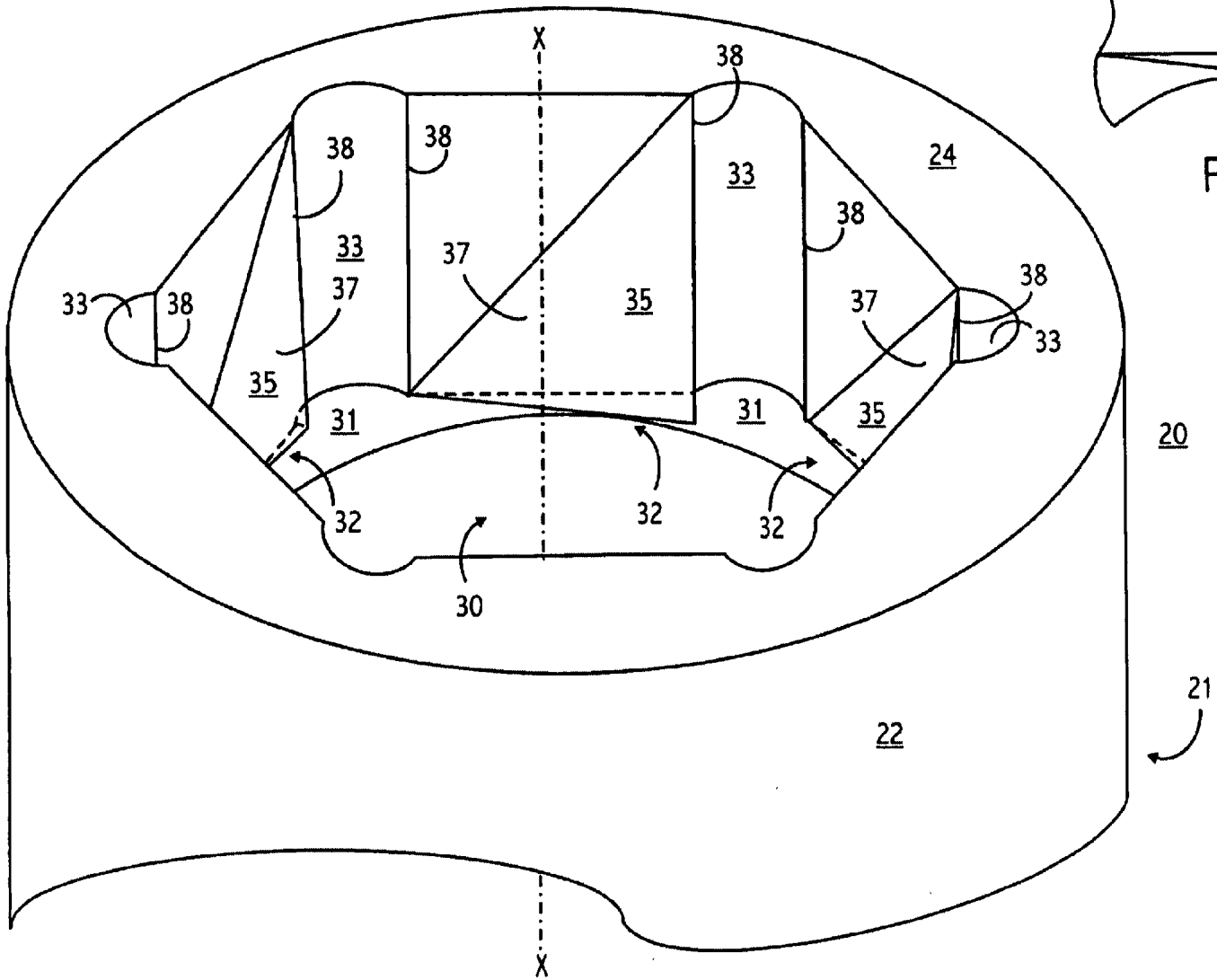
FIG. 5 is a fragmentary perspective view of a fifth form of a female socket, the female socket being a drive socket for a socket wrench.
Figure 6A:
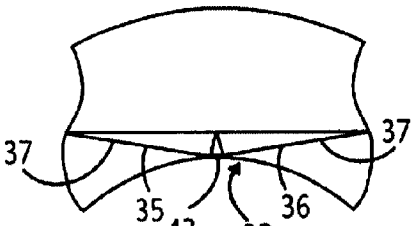
FIG. 6A is a fragmentary top plan view of the female socket of FIG. 6.
Figure 6:
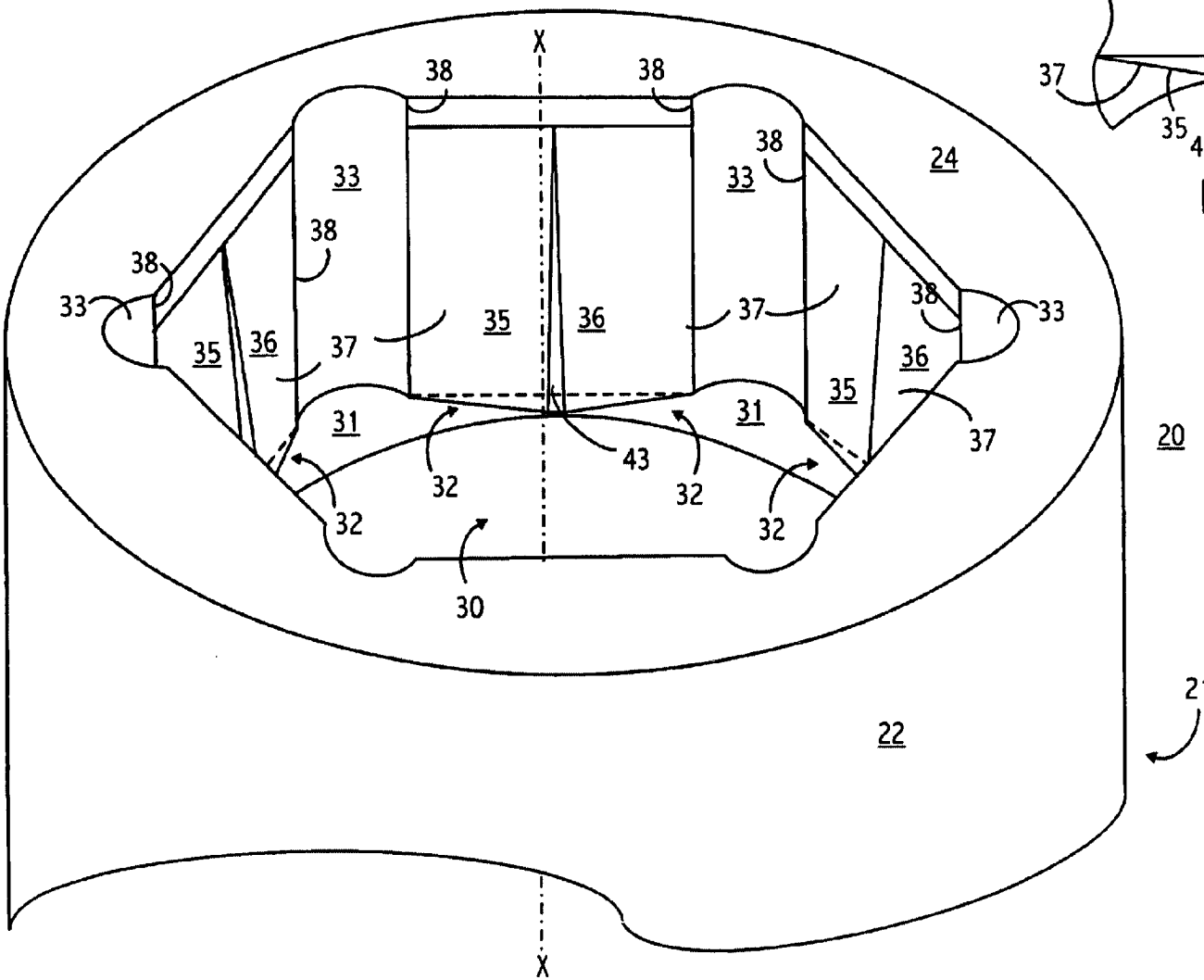
FIG. 6 is a fragmentary perspective view of a sixth form of a female socket, the female socket being a drive socket for a socket wrench.
Figure 7A:
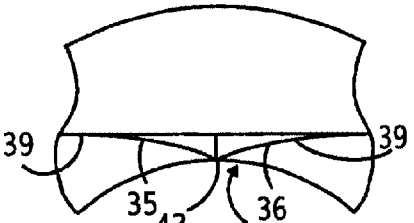
FIG. 7A is a fragmentary top plan view of the female socket of FIG. 7.
Figure 7:
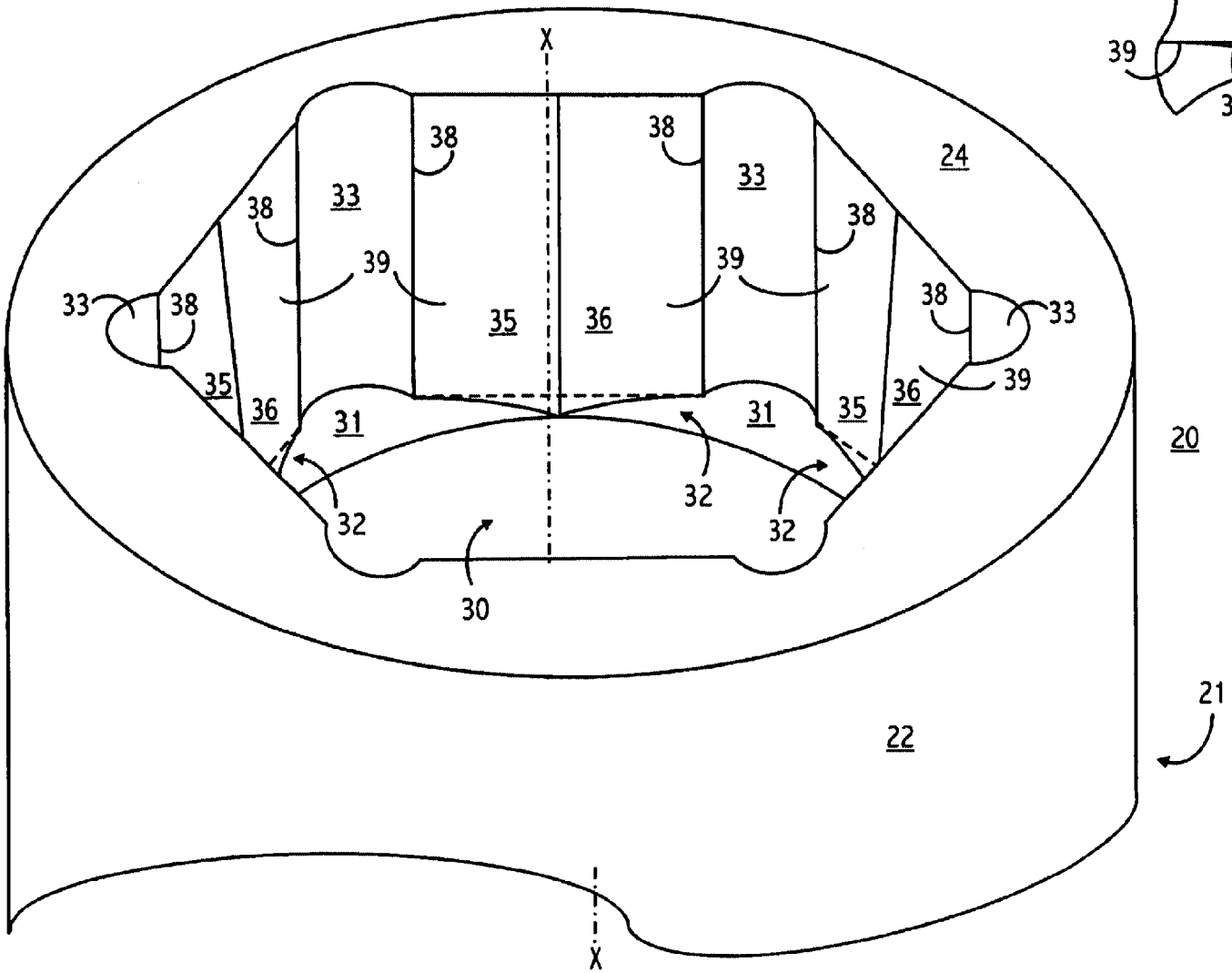
FIG. 7 is a fragmentary perspective view of a seventh form of a female socket, the female socket being a drive socket for a socket wrench.
Figure 10A:
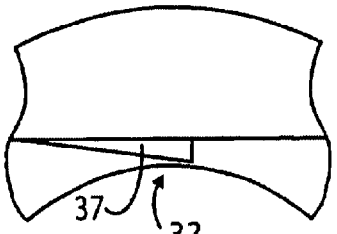
FIG. 10A is a fragmentary top plan view of the female socket of FIG. 10.
Figure 10:
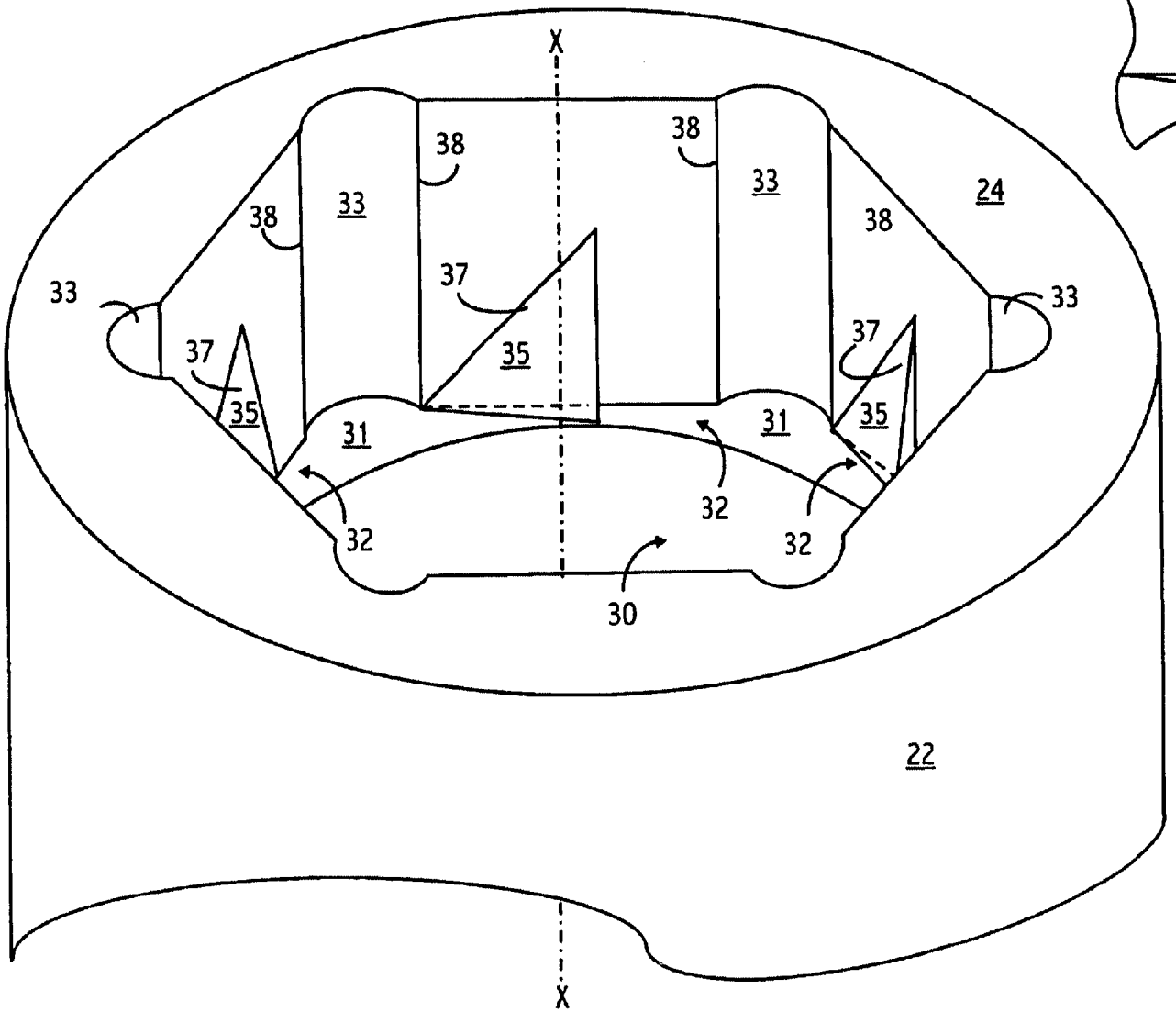
FIG. 10 is a fragmentary perspective view of an eighth form of a female socket, the female socket being a drive socket for a socket wrench.

As shown in FIGS. 1, 6 and 10, the drive surface 35, 36 extend from the inner end surface 31 towards the open outer end surface 24, but can end before reaching the open outer end surface 24. In another form, the drive surfaces 35, 36 can extend all the way to the top of the open outer end surface 24 (see FIGS. 2–5 and 7). The drive surfaces 35, 36 can have any suitably shaped surfaces, including a planar surface 37 (see FIGS. 1A, 2A, 4A, 5A, 6A and 10A) or curved surface, such as a concave curved surface 39 (see FIGS. 3A, 4A and 7A). It is thought that concave curved surface 39 might better accommodate irregularities and imperfections found in many drive members. The concave curved surface 39 can be used to provide a greater distribution of stress created when the fastener 34 is wedged in socket recess 30 because the curved surface allows for a greater amount of surface contact between the fastener 34 and the drive regions 32. The concave curved surface 39 connects the line contact with the corner contact, whereas the planar surface 37 has a smaller line contact that is separate from the contact at the corner channel.

In one form, one or more drive surfaces each comprise a clockwise drive surface 35 that has a positive slope from the left towards the right of the drive region 32. In another form, one or more drive surfaces each comprise a counterclockwise drive surface 36 that has a negative slope from the left towards the right of the drive region 32. As used herein, the terms right and left refer to the right and left direction of a drive region when it is viewed as depicted in the only full drive region 32 that is shown in both FIGS. 1 and 1A.

In one form, the drive socket 20 can have at least one drive region 32 that includes a clockwise drive surface 35 while at least one other drive region 35 includes a counterclockwise drive surface 36. Furthermore, the drive regions 32 can include both a clockwise drive surface 35 and a counterclockwise drive surface 36. When a drive region 32 comprise both clockwise and counterclockwise drive surfaces 35 and 36, the drive surfaces can meet at a point between the corner regions 33 that border the particular drive portion 32. In this manner, the drive surfaces 35 and 36 can form a peak 42 where the opposite sloping drive surfaces meet. In other forms, the drive surfaces 35 and 36 can form a a plateau 43 (shown in FIGS. 6 and 6A). However plateau 43 need not be flat as depicted, plateau 43 can have any suitable shape and can even have a radius, for example a convex radius.

As shown in FIGS. 5, 5A, 10 and 10A the drive socket 20 can have drive regions 32 that comprise only one type of the clockwise drive surfaces 35 and counterclockwise drive surfaces 36. If only one drive surface 35 or 36 is located on each drive region 32, it can be advantageous for the drive surface 35 or 36 to extend from a point adjacent the corner region 33 bordering one end of the drive region to a point adjacent the corner region bordering the other end of the drive region, as depicted in FIGS. 5 and 5A. In other cases, it can be advantageous for the drive surface 35 or 36 to extend from a point adjacent the corner region 33 bordering one end of the drive region to a point some distance the corner region bordering the other end of the drive region, as depicted in FIGS. 10 and 10A. The drive surface 35 or 36 can stop short of extending all the way between bordering corner regions 33 so that there is little, if any, friction causing the hex head bolt 34 to be retained when the socket 20 is rotated in one direction.

For example, the embodiment shown in FIGS. 10 and 10A can be used to have a larger amount of friction force from engagement when socket 20 is rotated in the clockwise direction to tighten hex head bolt 34 and a less amount of friction force from engagement when socket 20 is rotated in the counterclockwise direction. This design can allow hex head bolt 34 to more easily drop out of socket 20 when bolt 34 is loosened. This design's centering and holding feature may even reduce unwanted vibration between bolt 34 and socket 20 that would be felt by users using an impact wrench.

The outline of drive surfaces 35, 36 can have any suitable shape, however substantially polygonal shaped outlines such as substantially triangular shaped outlines (see FIGS. 1–5 and 10) and substantially rectangular shaped outlines (see FIGS. 4, 6 and 7) are illustrated. When there are two drive surfaces 35, 36 on a drive region, the outlines of drive surface 35, 36 can both be substantially triangular (see FIGS. 1–3), both substantially rectangular (see FIGS. 6 and 7), or one can be triangular and the other rectangular (see FIG. 4).

Figure 8:
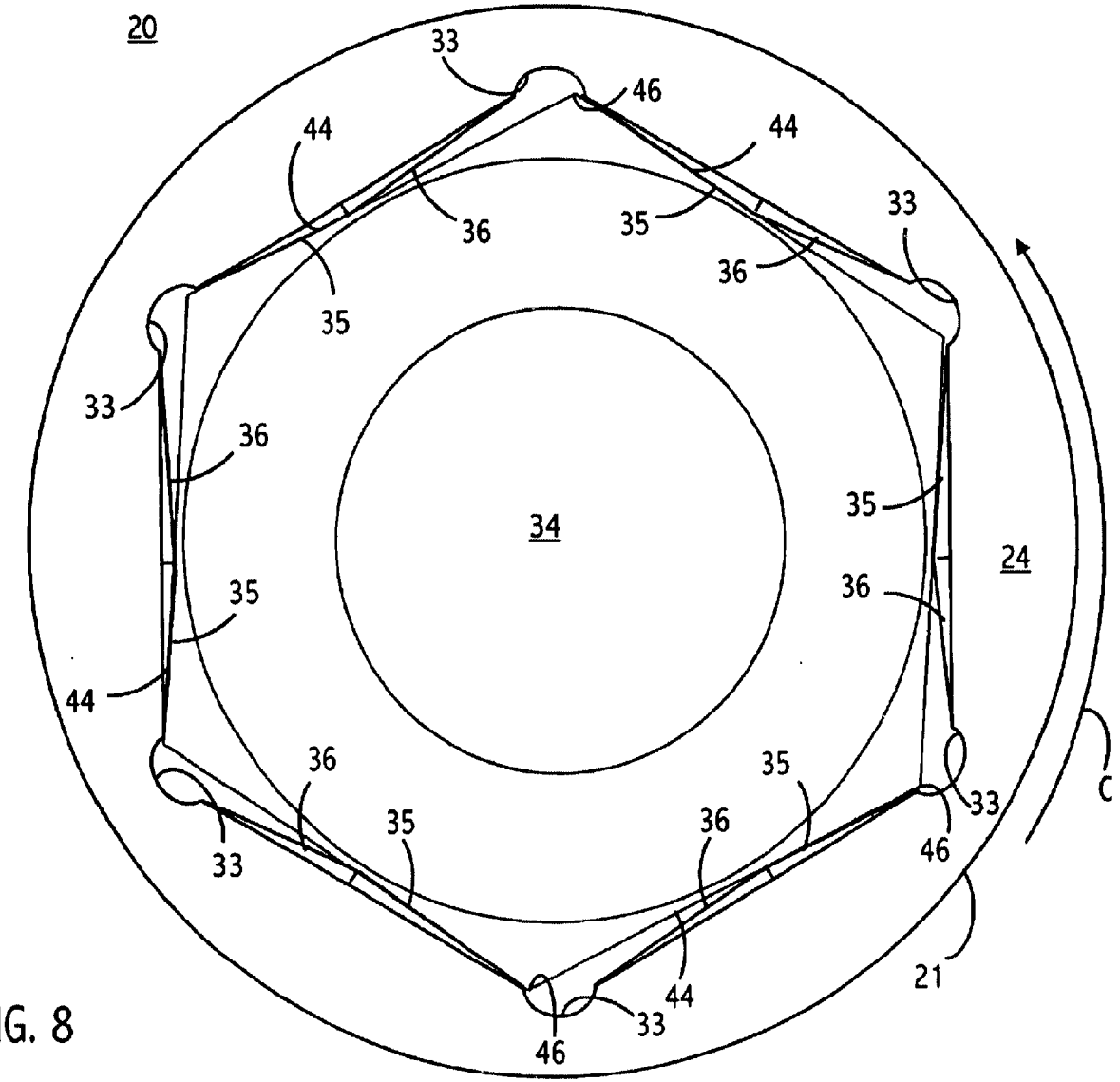
FIG. 8 is a top plan view of the female socket of FIG. 1 or FIG. 2 with a nut inserted therein when the female socket is spun in the clockwise direction indicated by the arrow labeled C.
Figure 9:
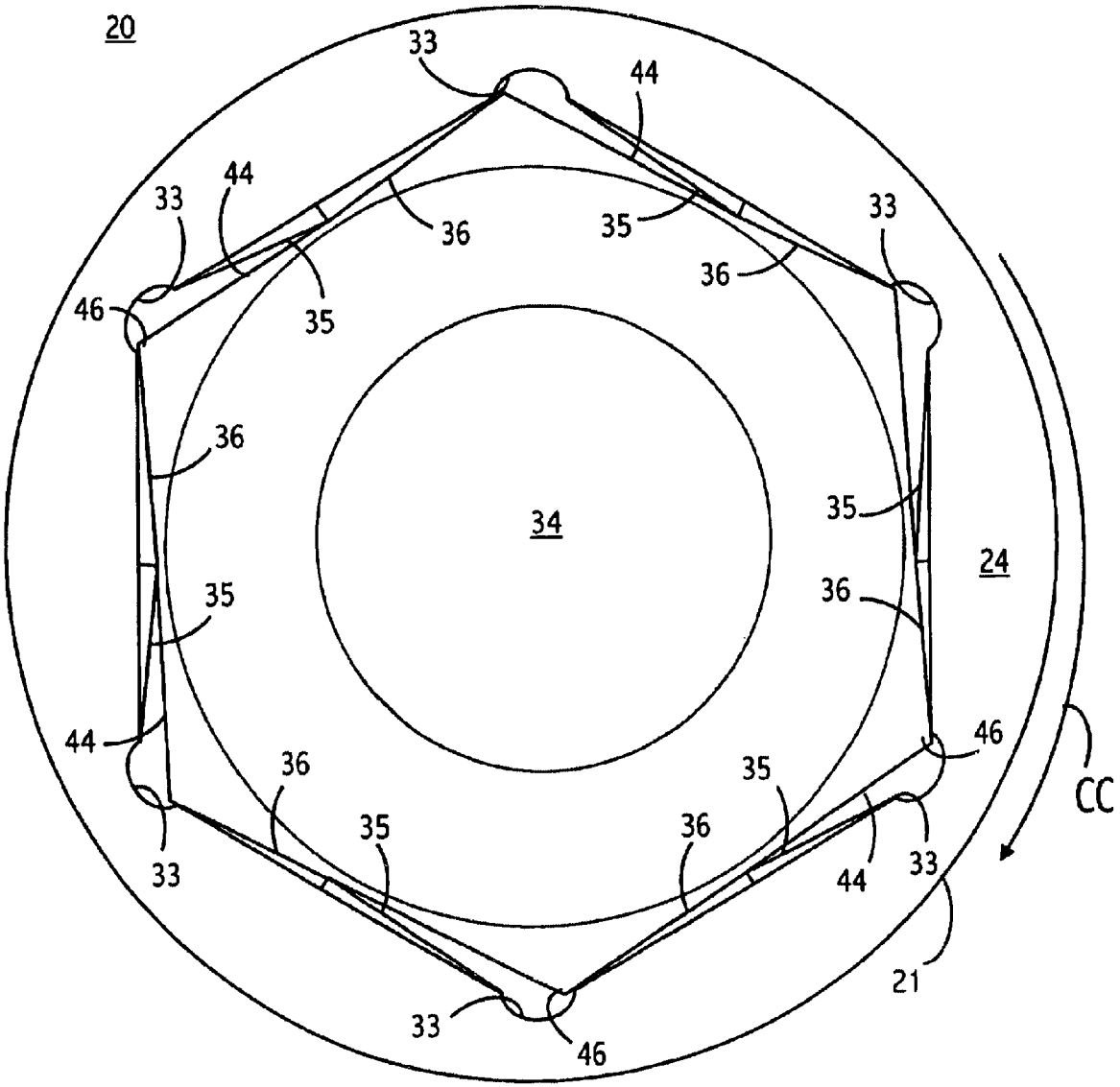
FIG. 9 is a top plan view of the female socket of FIG. 1 or FIG. 2 with a nut inserted therein when the female socket is spun in the counterclockwise direction indicated by the arrow labeled CC.

Referring to FIGS. 8 and 9, the operation of the drive socket 20 will be described in connection with an associated fastener 34 which, for purposes of illustration, is shown as a hex head bolt. The fastener 34 comprises alternating flats 44 and corners 46. As the fastener 34 enters the open end of the socket recess 30, as illustrated in FIGS. 8 and 9, the corners 46 of the fastener 34 are, respectively, radially aligned with the corner regions 33 of the socket recess 30, there being a clearance space therebetween depending upon the manufacturing tolerances for the fastener 34 and the drive socket 20 and the presence or absence of reliefs. As the fastener 34 progresses axially into the socket recess 30, the flats 44 thereof will, respectively, frictionally engage at least two drive surfaces 35 or 36, each on different drive regions 32, producing a wedge fit which will serve to releaseably retain the fastener 34 in engagement in the drive socket 20. Additionally, fastener 34 can also be retained in drive socket 20 merely by being wedged between one or more peaks 42 or plateaus 43, even if the drive socket 20 is not rotated in either direction.

As the drive socket 20 is rotated for rotating fastener 34, there may result an initial slight relative rotation of the drive socket 20 and the fastener 34, as indicated in FIGS. 8 and 9, but the bolt 34 will normally remain in a retained engagement with drive surface 35 or 36. When reliefs are present, the corners of the drive member will be prevented from engaging the drive socket 20, and even without corner reliefs, wear will be concentrated on the flats of the fastener.

When the drive socket 20 includes both clockwise and counter clockwise drive surfaces 35 and 36, the amount of surface area of each clockwise drive surface 35 that contacts fastener 34 will normally be larger when drive socket 20 rotates fastener 34 in the clockwise direction (labeled C) than when drive socket 20 rotates fastener 34 in the counterclockwise direction (labeled CC). Likewise, the amount of surface area of each counterclockwise drive surface 35 that contacts the fastener 34 will normally be larger when drive socket 20 rotates fastener 34 in the counterclockwise direction than when drive socket 20 rotates fastener 34 in the clockwise direction. As used herein, the clockwise and counterclockwise directions are used in the ordinary sense when viewing the back end of the drive socket (opposite the open outer end surface 24). Therefore the directions are labeled as shown in FIGS. 8 and 9 because those views are of the open outer end surface 24.

When drive socket 20 rotates fastener 34 in the clockwise direction, flats 44 of the bolt will normally be frictionally engaged between two or more clockwise drive surfaces 35. Similarly, when drive socket 20 rotates fastener 34 in the counterclockwise direction, flats 44 of the bolt will normally be frictionally engaged between two or more counterclockwise drive surfaces 36. After fastener 34 is rotated in one of the clockwise and counterclockwise directions, this process can be repeated to fasten and remove the same fastener 34 or to fasten or remove a second fastener 34 by rotating either bolt in the associated clockwise or counterclockwise directions.

Figure 11:
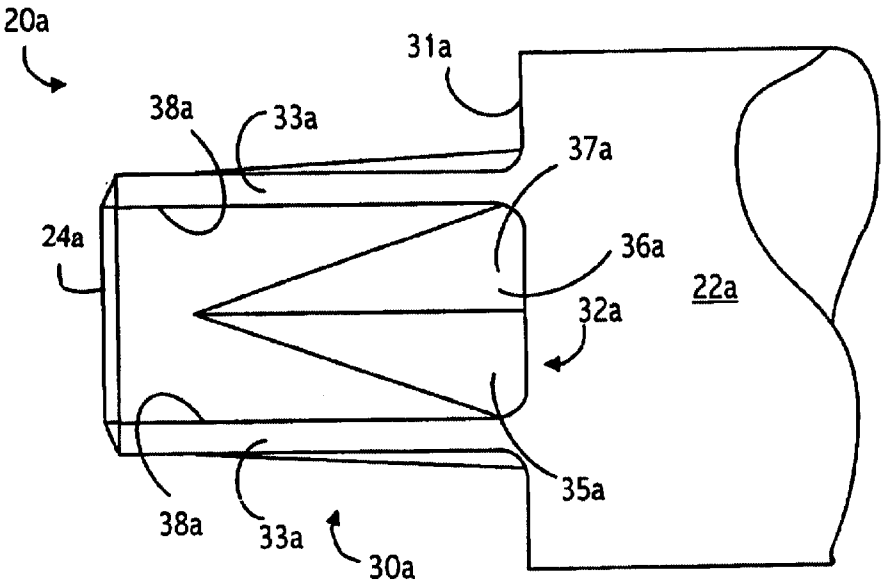
Figure 11A:
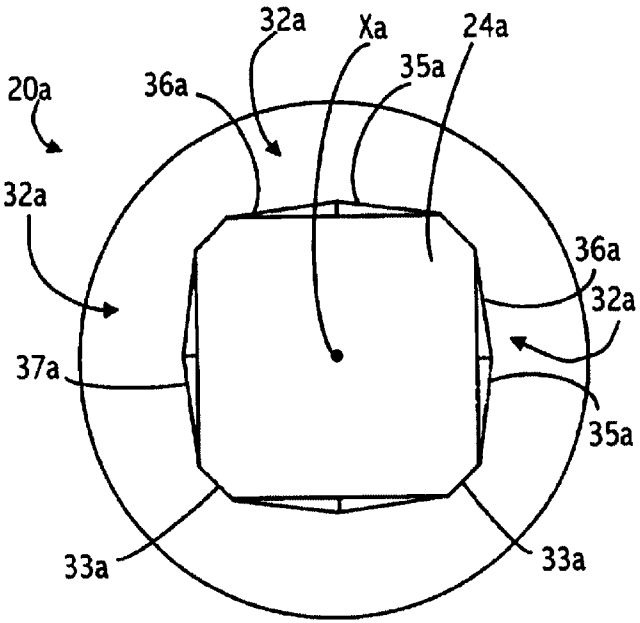
FIG. 11A is a fragmentary end view of the male member of FIG. 11.
Figure 12:
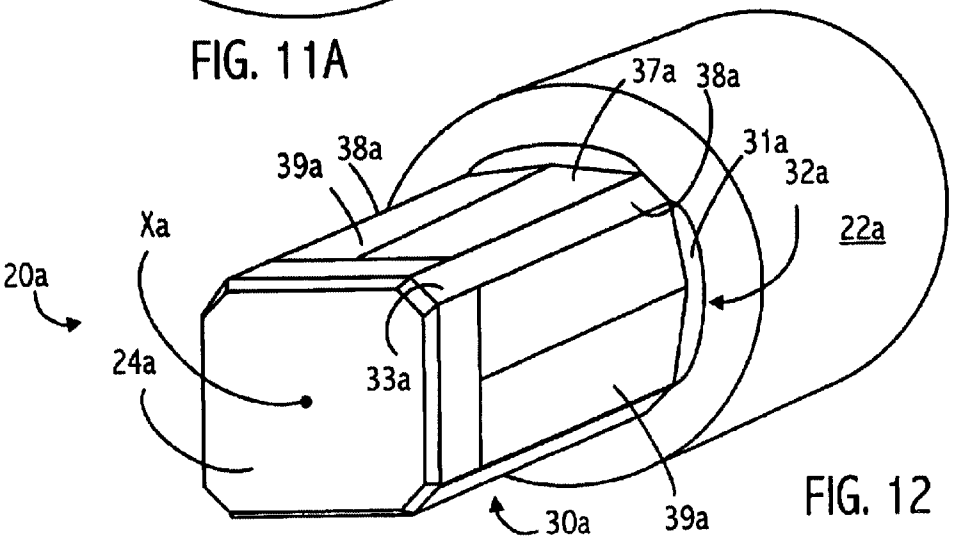

The slope of the drive surfaces 35, 36 may vary within a range of angles. Various factors that are used to determine such range are described in U.S. Pat. No. 5,277,531, which is incorporated herein by reference. The degree of the slope can be related to the broad range of fastener hex head tolerances. For example, the smaller the dimension across the flats on the fastener, the deeper the point where it will engage in the socket, likewise the larger this dimension then the shallower the point where it will engage in the socket. Thus, the slopes can be designed to compensate for the wide variations of fasteners dimensions and tolerances that a particular fastener driver would likely be used for. Referring to FIGS. 11, 11A and 12, it is shown that similar principles can be applied to male members that are inserted into female sockets. Because the similar principles apply, items that are analogous to those previously described have the same numbers with the suffix "a" after the number. There is illustrated a body in the nature of a male driver 20*a*, such as a male driver on a socket wrench and the like. The male driver 20*a* has a body 22*a* having an outer end surface 24*a* and an opposite end (not shown). The male driver 20*a* has a central rotational axis Xa extending through the centers of the outer end surface 24*a* and the opposite end. In one form, axis Xa is the axis of rotation of male driver 20*a*.

Projecting from the body 22*a* is a male portion 30*a*, which begins at outer end surface 24*a* and terminates in a back end surface 31*a* towards the rear of male portion 30*a*. The back end surface 31*a* is generally located between the outer end surface 24*a* and some point offset from the opposite end of male driver.

The male portion 30*a* has a generally polygonal shape at the outer end thereof, i.e., at the outer end surface 24*a*, the shape being generally square in the illustrated embodiment and including sides, such as drive regions 32*a*, spaced apart by corner regions 33*a*. In the illustrated embodiment, the male driver 20*a* has a plurality of alternating drive regions 32*a* and corner regions 33*a* arranged about a central axis Xa for cooperation to define the male portion 30*a*. Each of the illustrated corner regions 33*a* comprises a beveled corner forming a relief between two drive regions 32*a*. The reliefs prevent the corner portions 33*a* of male portion 30*a*, from contacting the interior corners of a standard square-shaped female opening that is used to couple a socket and a ratchet wrench. However, the corner regions 33*a* can also comprise differently shaped reliefs. In other cases, the corner regions 33*a* can even comprise normal corners when contacting the interior corners of a female opening is of less concern.

The drive region has one or more drive surfaces 35*a*, 36*a*, respectively extending from the drive regions 32*a* and sloping away from the central axis both generally parallel to the central axis Xa and generally traverse to the central axis Xa. In other words, one or more drive surfaces 35*a*, 36*a* slope away from the central axis in a first direction generally parallel to the central axis, for example along the shortest route between the outer end surface 24*a* and the back end surface 31*a*, and in a second direction generally traverse to the central axis, for example the shortest route between two edges 38*a* of drive region 32*a*. This sloping outward away from the central axis Xa determines the depth of insertion of the male portion 30*a* into a female opening and thus the area of engagement between the male driver 20*a* and the female opening in a socket. In one form, the slope is positive in a direction following the shortest route from the outer end surface 24*a* towards the back end surface 31 a and in one of the two directions that follow the shortest route between two edges 38*a* of the drive region 32*a*.

In one form, the drive surfaces 35*a*, 36*a* extend from the back end surface 31*a* towards the outer end surface 24*a* and also extend from a point adjacent one of corner regions 33*a* that borders one edge 38*a* of a drive region 32*a* and towards the other corner region 33*a* bordering the same drive region 32*a*. For purposes of illustration, the size of the drive surfaces 35*a*, 36*a* have been exaggerated in the drawings since, in some embodiments, they may be difficult to see with the naked eye.

As shown in FIGS. 11 and 12, the drive surface 35*a*, 36*a* extend from the back end surface 31*a* towards the outer end surface 24*a*, but can end before reaching the outer end surface 24*a*. In another form, the drive surfaces 35*a*, 36*a* can extend all the way to the top of the outer end surface 24*a* (not shown). The drive surfaces 35*a*, 36*a* can have any suitably shaped surfaces, including a planar surface 37*a* (see FIG. 11A) or curved surface.

In one form, one or more drive surfaces each comprise a clockwise drive surface 35*a* that has a positive slope from the bottom towards the top of the drive region 32*a*. In another form, one or more drive surfaces each comprise a counterclockwise drive surface 36*a* that has a negative slope from the bottom towards the top of the drive region 32*a*. As used herein, the terms bottom and top refer to the bottom and top direction of a drive region when it is viewed as depicted in the only full drive region 32*a* that is shown in both FIGS. 11 and 11A. Drive surfaces 35*a* and 36*a* can be made with the same variations and combinations previously described for drive surfaces 35 and 36 of drive socket 20.

The operation of the male driver 20*a* is similar to that previously described for drive socket 20 except that the male driver 20*a* is inserted into a square female opening comprising alternating flats and corners and it is drive surfaces 35*a* or 36*a* that engage the flats of the female opening. Additionally, corner portions 33*a* can be beveled to prevent contact with the interior corners of the female opening.

While the device has been disclosed in FIGS. 1–12 as embodied in a drive socket 20 and male driver 20*a*, it will be appreciated that the principles are applicable to any rotatably driveable device, including those disclosed in U.S. Pat. No. 5,277,531 and can even be applied to the associate male portions of common hex-headed or square-headed nuts and bolts. While, devices that are substantial square-shaped or substantially hex-shaped are depicted, the principles are also applicable to other polygon-shaped devices and other appropriately shaped devices. While the foregoing embodiments are drive sockets and drivers for ratchet wrenches and similar devices, it will be appreciated that the principles of the disclosed device and method are applicable to any socketed device which is adapted to receive an associated male member in engagement in the socket. Likewise the principles of the disclosed device and method are applicable to a male member which is adapted to be received by and to retain an associated female member.

From the foregoing, it can be seen that there has been provided an improved device having either a male member or a female socket which is configured to produce a retention interference fit with an associated female socket or male member.

We claim:

1. A device comprising: a body having a plurality of alternating drive regions and corner regions arranged about a central axis, each drive region having disposed thereon and confined thereto only one drive surface which has intersecting edges lying in a plane which intersects the central axis and which has a predetermined slope relative to the axis.

2. A device comprising: a body having a plurality of alternating drive regions and corner regions arranged about a central axis for cooperation to define a socket recess having an open outer end and an inner end, each drive region having disposed thereon and confined thereto only one drive surface which has intersecting edges lying in a plane which intersects the central axis and which has a predetermined slope relative to the axis.

3. The device of claim 2, wherein a first drive region includes a first drive surface having a clockwise drive portion and a second drive region includes a second drive surface disposed thereon and confined thereto, the second drive surface sloping toward the central axis in a first direction generally parallel to the central axis and in a second direction generally traverse to the central axis, wherein the second drive surface includes a counterclockwise drive portion.

4. The device of claim 2, wherein the at least one drive region includes first and second drive surfaces, and wherein each of the first and second drive surfaces slopes toward the central axis in a first direction generally parallel to the central axis and in a second direction generally traverse to the central axis.

5. The device of claim 4, wherein the first and second drive surfaces intersect at a line disposed between two corner regions that border the at least one drive region.

6. The device of claim 4, wherein at least one of the first and second drive surfaces includes a curved surface.

7. The device of claim 6, wherein the curved surface is concave.

8. The device of claim 4, wherein the first drive surface includes a counterclockwise drive portion.

9. The device of claim 8, wherein the second drive surface includes a clockwise drive portion.

10. The device of claim 4, wherein at least one of the first and second drive surfaces is substantially polygonal in outline.

11. The device of claim 10, wherein the at least one of the first and second drive surfaces is substantially rectangular in outline.

12. The device of claim 10, wherein the at least one of the first and second drive surfaces is substantially triangular in outline.

13. The device of claim 12, wherein the other of the first and second drive surfaces is substantially rectangular in outline.

14. The device of claim 13, wherein the central axis is the axis of rotation of the body.

15. The device of claim 14, wherein the body is a drive socket for a socket wrench.

16. The device of claim 15, wherein at least one corner region includes a relief.

17. The device of claim 16, wherein the relief is a channel formed between two drive regions.

18. A device comprising: a body having a plurality of alternating drive regions and corner regions arranged about a central axis for cooperation to define a male member, each drive region having disposed thereon and confined thereto only one drive surface which has intersecting edges lying in a plane which intersects the central axis and which has a predetermined slope relative to the axis.

* * * * *